US007428877B2

(12) United States Patent
Tsumiyama

(10) Patent No.: US 7,428,877 B2
(45) Date of Patent: Sep. 30, 2008

(54) SMALL WATERCRAFT

(75) Inventor: Yoshinori Tsumiyama, Miki (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/648,496

(22) Filed: Dec. 29, 2006

(65) Prior Publication Data

US 2008/0156249 A1 Jul. 3, 2008

(51) Int. Cl.
*B63B 5/24* (2006.01)
*B63B 3/00* (2006.01)

(52) U.S. Cl. ..... 114/357; 114/355

(58) Field of Classification Search ..... 114/355, 114/357, 55.5
See application file for complete search history.

(56) References Cited

U.S. PATENT DOCUMENTS 4,760,811 A * 8/1988 Hopper ..... 114/65 R
7,201,111 B1 * 4/2007 Burkett ..... 114/271
2004/0146714 A1 * 7/2004 McCollum et al. ..... 428/411.1

* cited by examiner

*Primary Examiner*—Lars A Olson
*Assistant Examiner*—Daniel V Venne
(74) *Attorney, Agent, or Firm*—Alleman Hall McCoy Russell & Tuttle LLP

(57) ABSTRACT

A small watercraft is provided. The small watercraft comprises a hull formed to have a substantially uniform thickness by using reinforced fibers impregnated with resin. The hull includes a curved portion formed by protruding outward and curving a part of the hull, and a filling material filled in a groove portion on an inner side of the hull which is created by forming the curved portion.

7 Claims, 7 Drawing Sheets

SMALL WATERCRAFT

TECHNICAL FIELD

The present invention relates to a small watercraft and, more particularly to a reinforcement structure of a spray strip portion provided on a hull of the small watercraft, and a manufacturing method thereof.

BACKGROUND ART

Small watercraft (e.g., PWC) are in some cases provided with a spray strip portion at a front portion of a hull or a bow. The spray strip portion is also called a chine or a spray deflector formed to improve sea kindliness. The spray strip portion is typically a protruding portion formed by curving and protruding outward a part of the hull and by extending it in a longitudinal direction of the hull. One to four spray strip portions are provided on both sides of the hull at different vertical positions.

The spray strip portion is manufactured in such a manner that FRP sheets impregnated with thermosetting resin or the like are stacked to conform in shape to a mold (female mold) of the hull having grooves corresponding to the spray strip portions and are pressed from downward to upward using a roller or the like every time an FRP sheet is stacked, to avoid uneven heating of the spray strip portion in a thermal hardening process.

In this process, the roller falls into the groove portion of the spray strip portion and reduces the thickness of a bottom region of the groove portion, whereas a region immediately above the thinned region is made to have a larger thickness. This results in a hull cross-sectional shape in which stress concentration is likely to occur on the groove portion. Such stress concentration tends to occur particularly on the spray strip portion located higher whenever a front bottom portion of the hull hits on the water surface while skipping on the water surface, thereby decreasing stiffness of the hull.

In addition, as described above, non-uniform thickness may cause the spray strip portion to be unevenly heated and may adversely affect a quality of a product if it is directly thermally hardened.

SUMMARY OF THE INVENTION

The present invention has been developed under the circumstances, and provides a reinforced spray strip structure of a small watercraft and a manufacturing method thereof.

According to a first aspect of the present invention, there is provided a small watercraft comprising a hull formed to have a substantially uniform thickness by using reinforced fibers impregnated with resin, the hull including a curved portion formed by protruding outward and curving a part of the hull; and a filling material filled in a groove portion on an inner side of the hull which is created by forming the curved portion.

In such a construction, the hull which is not substantially susceptible to stress concentration and is stiff can be provided.

The curved portion may be a spray strip portion formed on a bow of the hull.

The groove portion filled with the filling material may define a smooth curved line together with an inner surface of the hull around the groove portion.

The curved portion may include a plurality of curved portions. In this case, the smooth curved line may extend over a plurality of groove portions on the inner side of the hull which are created by forming the plurality of curved portions.

The smooth curved line may be a circular-arc curved line.

According to a second aspect of the present invention, there is provided a method of manufacturing a spray strip portion of a small watercraft, comprising: forming a hull to have a substantially uniform thickness by using reinforced fibers impregnated with resin and protruding outward and curving a part of the hull to form the spray strip portion; thermally hardening the hull provided with the spray strip portion; and filling a filling material in a groove portion on an inner side of the hull that is created by forming the spray strip portion.

In such a construction, the hull which is not substantially susceptible to stress concentration and is stiff can be provided. Further, since the filling material is filled into the groove portion after the spray strip portion is formed, uneven heating of thermosetting resin in a thermal hardening process will not occur, and therefore, a quality of a product will not be degraded.

BRIEF DESCRIPTION OF THE DRAWINGS

The disclosure is illustrated by way of example and not by way of limitation in the figures of the accompanying drawings, in which the like reference numerals indicate similar elements and in which.

DETAILED DESCRIPTION

Hereinafter, a small watercraft of the present invention will be described with reference to the accompanying drawings.

Figure 1:
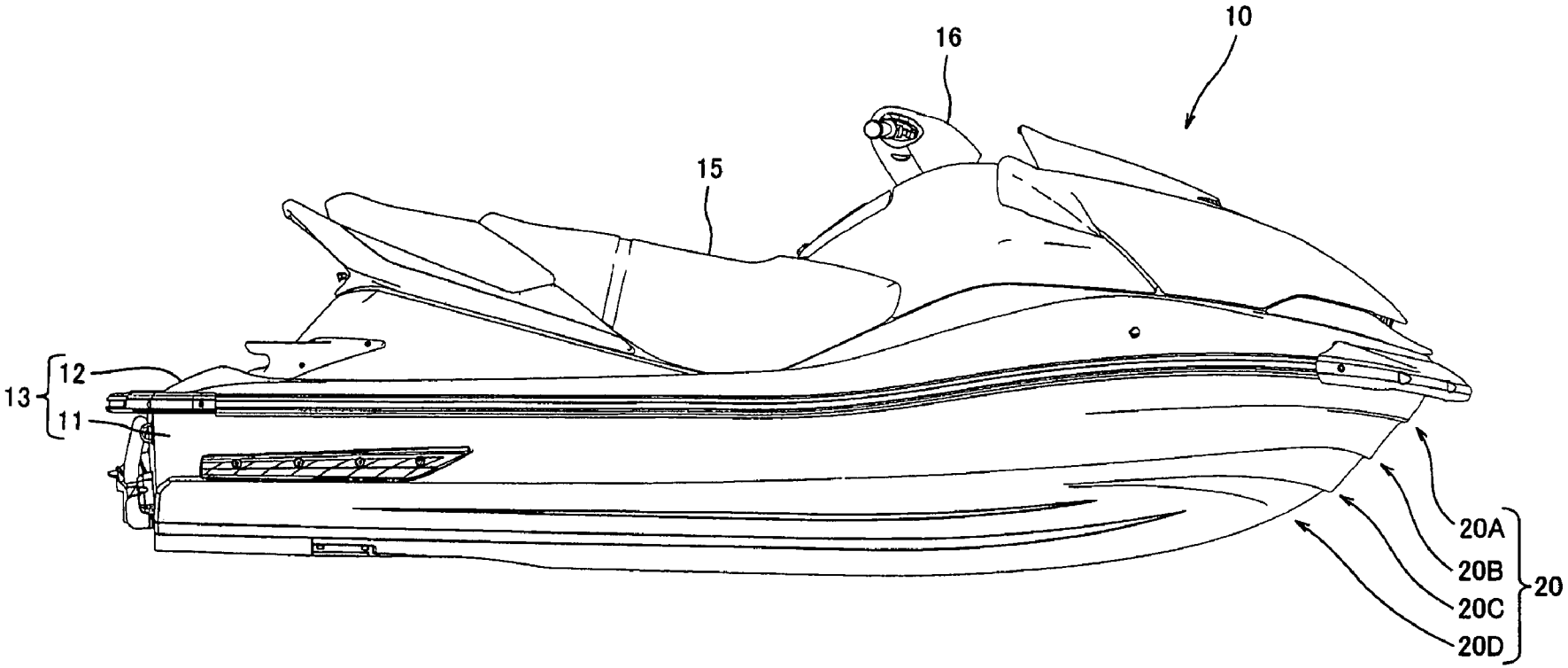
FIG. 1 is a right side view of a small watercraft according to an embodiment of the present invention.

FIG. 1 shows a water-jet propulsion personal watercraft 10 according to an embodiment of the present invention. A body 13 of the personal watercraft 10 includes a hull 11 and a deck 12 covering the hull 11 from above.

A seat 15 is mounted over a region extending from a center region to a rear region in a longitudinal direction of the deck 12, and is configured to be straddled by an operator. A bar-type steering handle 16 is attached to a portion of the deck 12 in front of the seat 15.

In this embodiment, the hull 11 includes four spray strip portions 20 (20A, 20B, 20D, and 20D) at a portion forward of the steering handle 16. The spray strip portions 20 are disposed at different vertical positions, and are arranged in the order of the 20A, 20B, 20C, and 20D from above.

As used herein, the term "spray strip portion" is one example of a "curved portion." The term "curved portion" includes the above mentioned chine, spray deflector, and other portions, and is, of course, applicable to other similar construction of the body of the watercraft.

Figure 2:
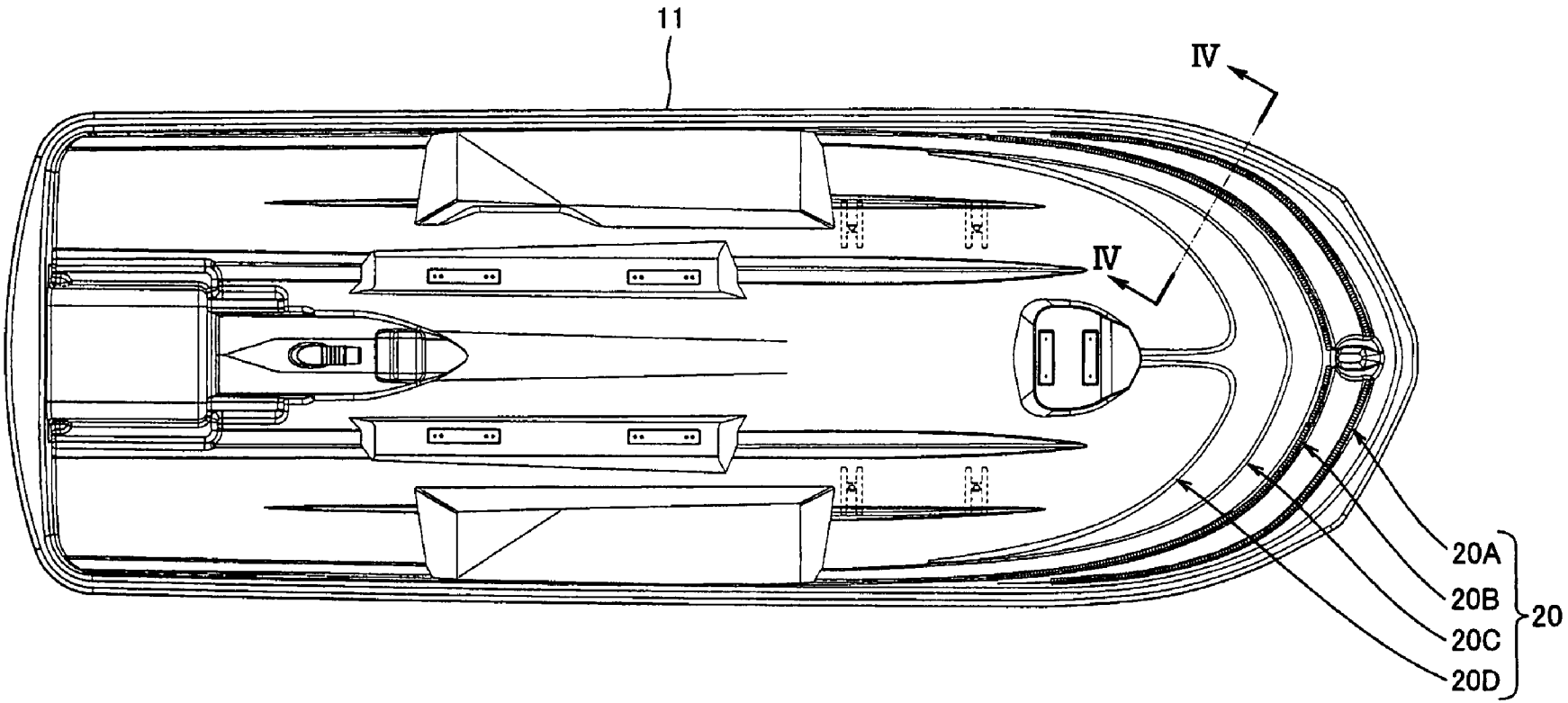
FIG. 2 is a plan view of a hull of the small watercraft of FIG. 1, showing a state where a deck portion is not mounted to a hull yet.
Figure 3:
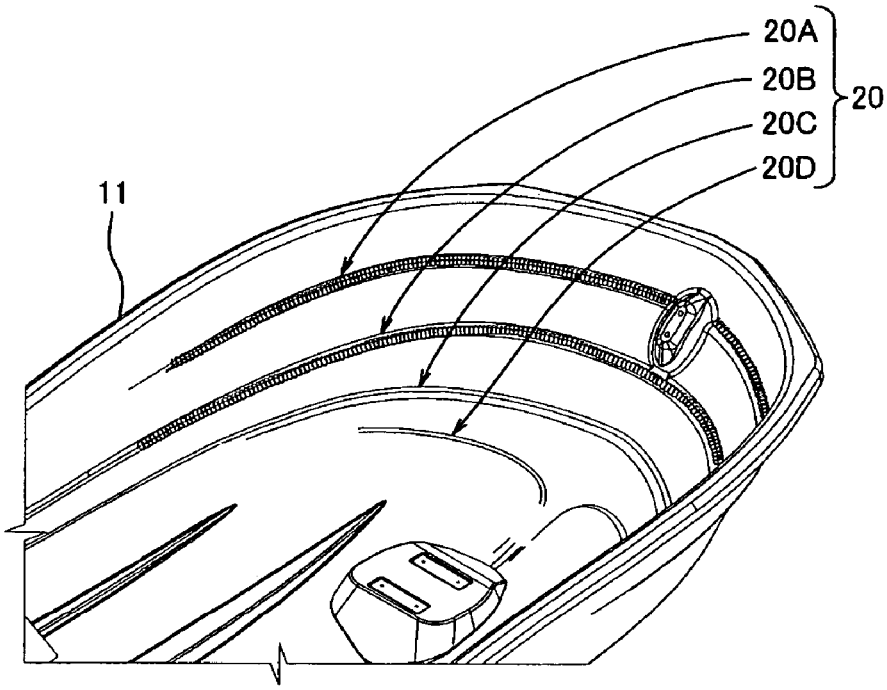
FIG. 3 is a perspective view of spray strip portions formed at a front end portion of the hull of FIG. 2, as viewed from rightward and backward.

FIGS. 2 and 3 are a plan view and a perspective view showing the interior of the hull 11 to which the deck 12 is not mounted yet. As shown in FIGS. 2 and 3, in this embodiment, a filling material 22 (see FIG. 4) is applied to the spray strip portions 20A and 20B that are located on an upper side and are particularly susceptible to stress concentration as described above.

It is advantageous that the filling material 22 is made of a material which forms a hull body (e.g., thermosetting FRP) or a similar material, in order to improve stiffness of the entire hull. But, this is merely exemplary and a bond (urethane based bond, bonding agent or other bond), putty, and others may be used. As the bond, the bond used to join the deck 11 and the hull 12 may be used so that the body 13 is manufactured easily. In addition, by using flexible bond, the hardened bond advantageously well conforms to a deformed shape of the hull 12 and does not substantially peel off from the hull body. Furthermore, by using quick-drying putty, a manufacturing time can be reduced.

Figure 4:
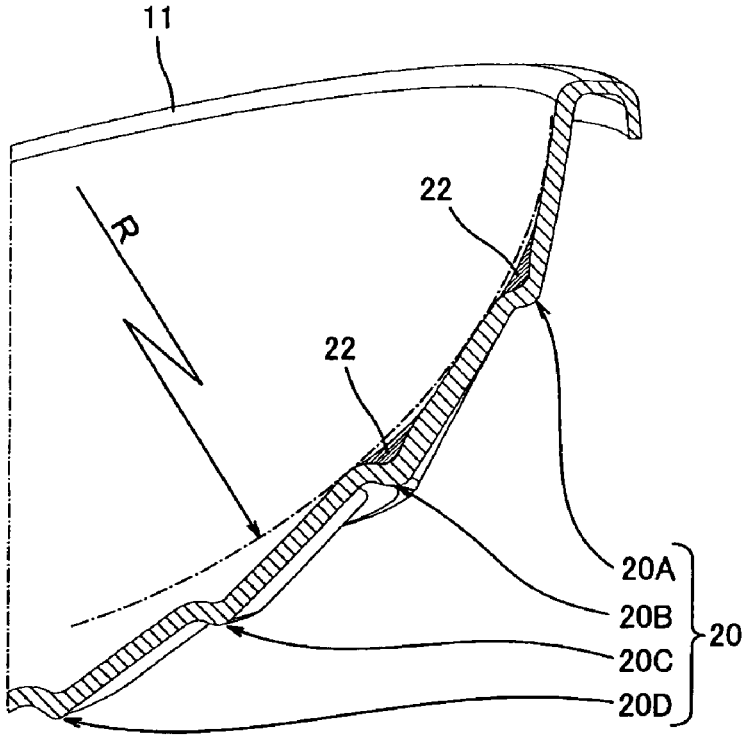
FIG. 4 is a cross-sectional view taken along line IV-IV of FIG. 2, showing a hull portion provided with the spray strip portions.

As can be seen in FIG. 4 showing the cross-section of the hull 11, taken along line IV-IV, the filling material 22 is typically filled over the entire length of inner groove portions 201*a* and 202*a* (see FIG. 5A) of the spray strip portions 20A and 20B. Preferably, the surface of the filling material 22 is formed into a curved surface continuous with at least an inner surface of the hull body to which the filling material 22 is applied. More preferably, the inner surface of the hull body filled with the filling material 22 is formed in a circular-arc shape with an identical radius R. This makes it difficult to cause stress concentration, and as a result, improves stiffness of the body.

Figure 5A:
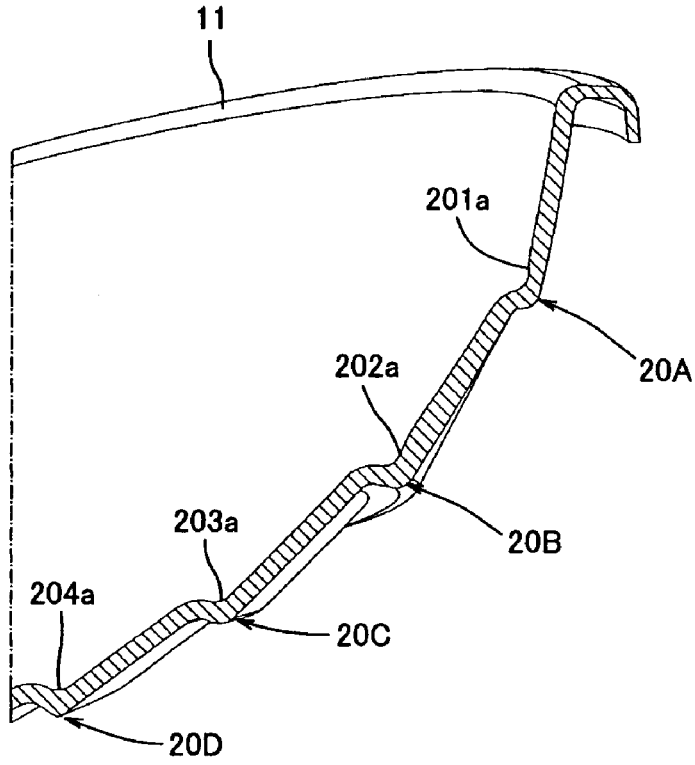
FIGS. 5A and 5B show a manufacturing method of the spray strip portions of FIG. 4.

Next, with reference to FIGS. 5A, 5B, and the flowchart of FIG. 6, the manufacturing method of the spray strip portion 20 will be described. In step S1, as shown in FIG. 5A, the FRP sheets impregnated with thermosetting resin are stacked to conform in shape to a mold of the hull (female mold) having groove portions corresponding to the spray strip portions and are typically pressed from downward to upward using a roller or the like every time an FRP sheet is stacked, to avoid uneven heating of the spray strip portions in a thermal hardening process. Thereafter, the FRP sheets are thermally hardened to form the spray strip portions 20.

In this embodiment, the hull is manufactured by a hand lay-up method, but may alternatively be manufactured by other methods such as a SMC method or a spray-up method.

In this process, the roller may in some cases fall into the groove portions 201*a*, 202*a*, 203*a*, and 204*a* of the spray strip portions 20 and reduce the thickness thereof, while regions located immediately above the thinned regions are made to have a larger thickness. This results in a hull cross-sectional shape in which stress concentration is likely to occur on the groove portion. Accordingly, in step S2, as shown in F*ig*. 5A and 5B the filling material 22 is applied to the groove portions (herein 201*a* and 202*a*where the stress concentration is most likely to occur), and the inner surface of the hull around the spray strip portions 20 is formed to have a smooth curved line using a scraper, etc.

At this time, the filling material 22 may be thermally hardened when the thermosetting FRP is used as the filling material 22. By thus carrying out the thermal hardening process at two stages, the product quality of even the spray strip portions 20 which may have uneven thickness are not degraded, and hence the hull 11 that is stiff and is not substantially deformed can be manufactured. In a case where the bond, adhesive, or the like is used as the filling material 22, it is dried and hardened directly or after its temperature is increased.

Alternatively, the FRP sheet may cover the filling material 22 from above and may be hardened together with the filling material 22.

Figure 5B:
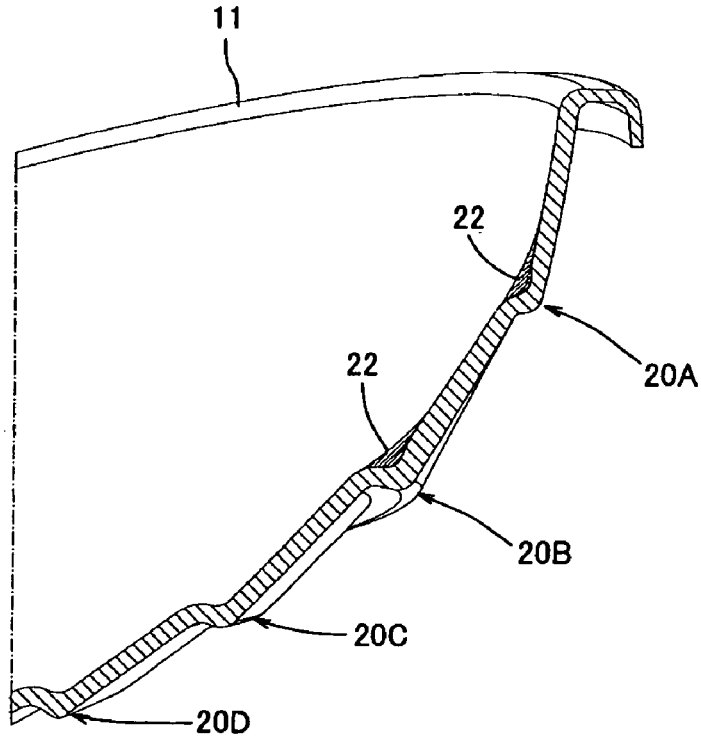
Figure 6:
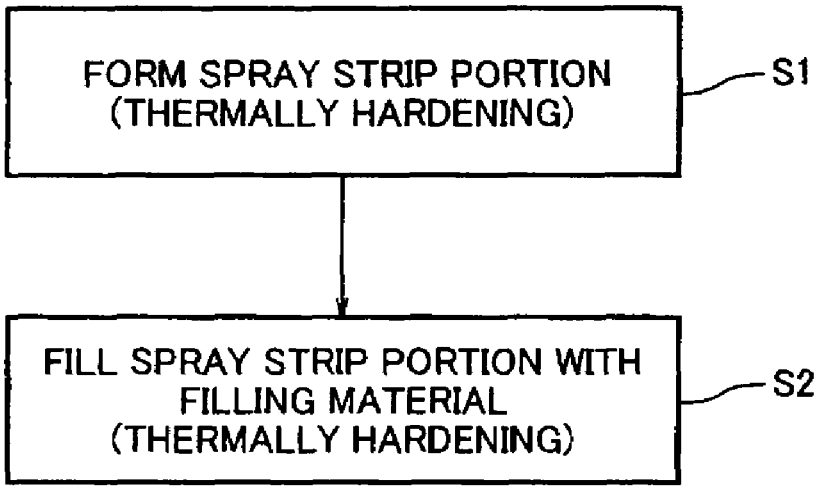
FIG. 6 is a flowchart showing the manufacturing method of the spray strip portions of FIGS. 5A and 5B.
Figure 7A:
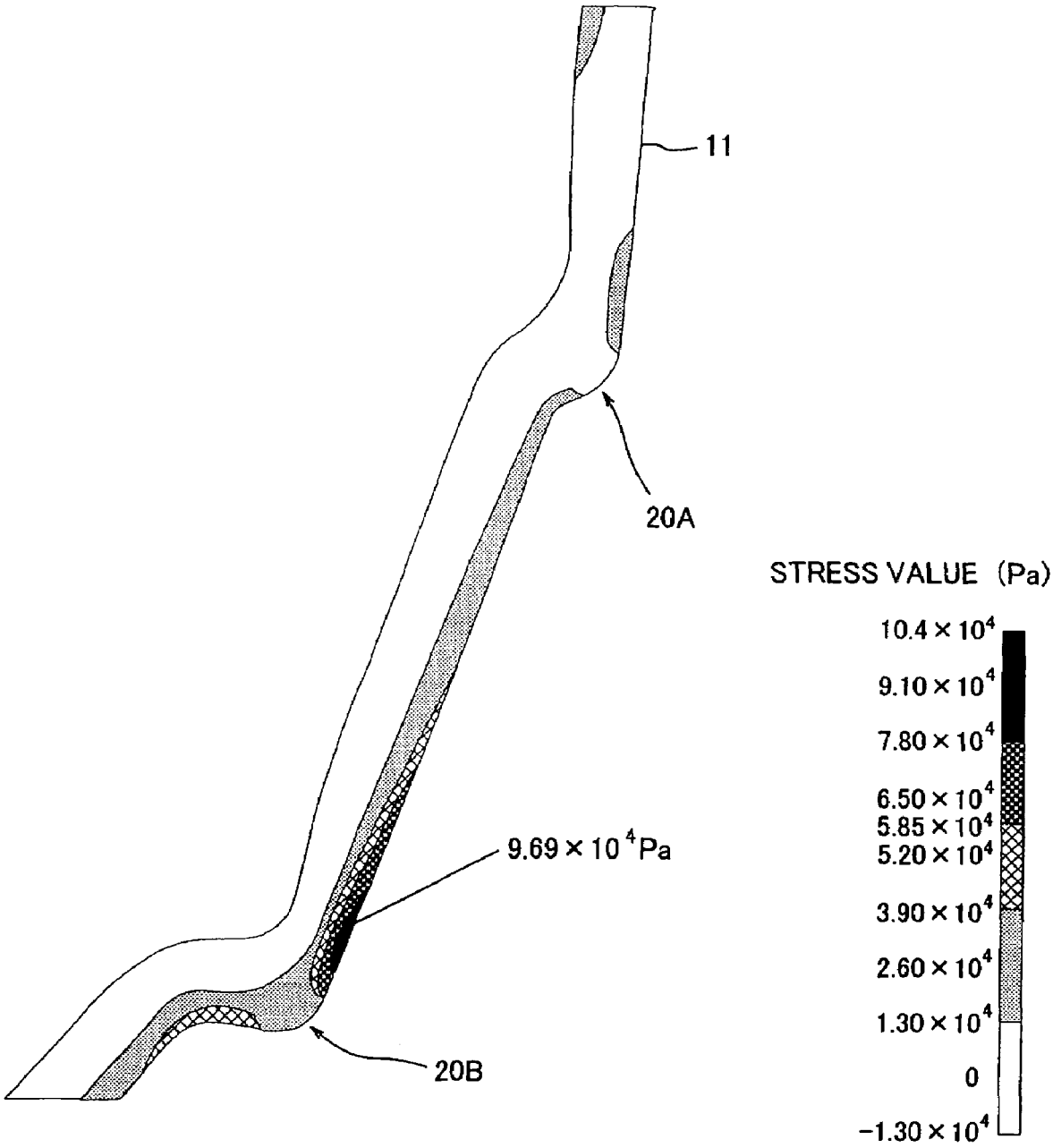
FIG. 7A shows a stress distribution of a hull cross-section according to a prior art or in step 1 of FIG. 6.
Figure 7B:
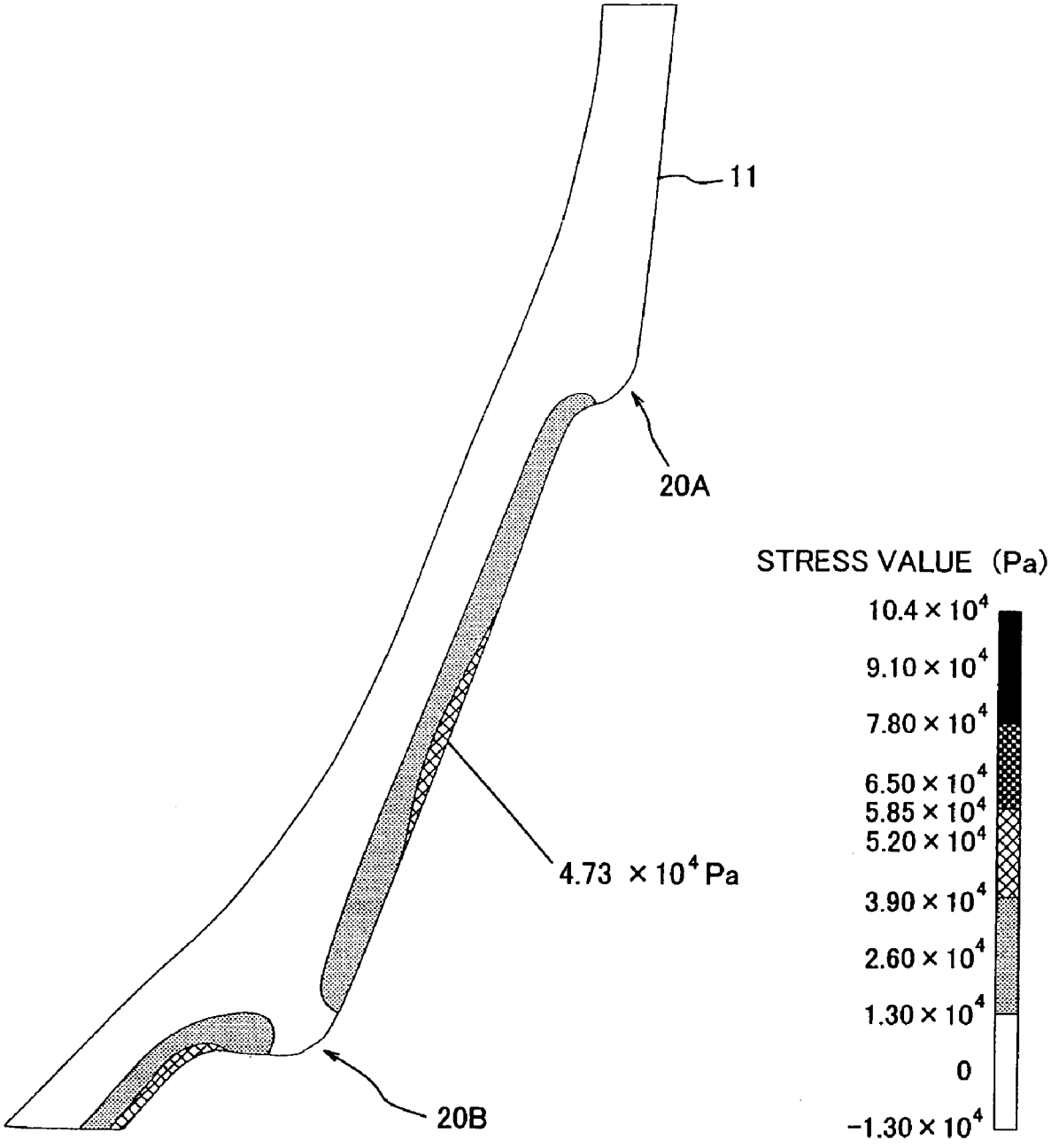
FIG. 7B shows a stress distribution of the hull cross-section according to an embodiment of the present invention or in step 2 in FIG. 6.

FIGS. 7A and 7B show analysis results of simulation of a stress distribution occurring when the front bottom portion of the hull hits on the water surface while skipping on the water surface, with respect to the spray strip portions 20 shown in FIGS. 5A and 5B. To be specific, FIG. 7A shows the spray strip portions 20 which are not applied with the filling material 22 according to this embodiment or according to the prior art, whereas FIG. 7B shows the spray strip portions 20 to which the filling material 22 is applied according to this embodiment. In FIGS. 7A and 7B, each stress distribution is hatched in different ways.

As shown in FIG. 7A, the stress concentration occurs in the spray strip portions 20A and 20B to which the filling material 22 is not applied. On the other hand, as clearly shown in FIG. 7B, the stress is well dispersed in the spray strip portions 20A and 20B manufactured by filling the filling material 22.

Such stress dispersion is effectively achieved by forming the continuous curved surface over the plural spray strip portions 20.

Although the present disclosure includes specific embodiments, specific embodiments are not to be considered in a limiting sense, because numerous variations are possible. The subject matter of the present disclosure includes all novel and nonobvious combinations and subcombinations of the various elements, features, functions, and/or properties disclosed herein. The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of features, functions and elements, and/or properties may be claimed through amendment of the present claims or through presentation of new claims in this or a related application. Such claims and whether broader, narrower, equal, and/or different in scope to the original claims, also are regarded as included within the subject matter of the present disclosure.

The invention claimed is:

1. A small watercraft comprising:

a hull formed to have a substantially uniform thickness by using reinforced fibers impregnated with resin, the hull including:

a curved portion formed by protruding outward from an outer surface of a part of the hull so as to have a groove portion inside thereof, wherein the curved portion is a spray strip portion formed on a bow of the hull; and a filling material filled in the groove portion;

wherein the filling material differs from said reinforced fibers impregnated with resin forming the hull; and wherein the filling material is filled in the groove portion, such that a surface of the filling material defines a continuous smooth curved surface connecting an inner surface of the hull above the groove portion and an inner surface of the hull below the groove portion in a section across the groove portion in upward and downward directions.

2. The small watercraft according to claim 1, wherein the spray strip portion includes a plurality of spray strip portions, and the the spray strip portions have a plurality of groove portions inside thereof, respectively, filled with the filling material so as to have the continuous smooth curved surface.

3. The small wateroraft according to claim 1, wherein the smooth curved surface is circular-arc curved.

4. A method of manufacturing a hull of a small watercraft, comprising:

forming the hull to have a substantially uniform thickness by using reinforced fibers impregnated with resin and by protruding outward from an outer surface thereof to form a spray strip portion having a groove inside thereof on a bow of the hull;

thermally hardening the hull after forming the hull;

filling a filling material in the groove portion of the spray strip portion such that a surface of the filling material defines a continuous smooth curved surface connecting an inner surface of the hull above the groove portion with an inner surface of the hull below the groove portion in a section crossing the groove portion in upward and downward directions after thermally hardening the hull, wherein the filling material is made of reinforced fiber impregnated with resin; and thermally hardening the filling material after filling the filling material.

5. The small watercraft according to claim 1, wherein a bond is used as the filling material.

6. The small wateroraft according to claim 5, wherein the bond is used to join the hull and a deck of the small watercraft.

7. The small watercraft according to claim 1, wherein a putty is used as the filling material.

* * * * *